US006669456B2

(12) United States Patent
Kim

(10) Patent No.: US 6,669,456 B2
(45) Date of Patent: Dec. 30, 2003

(54) SCROLL COMPRESSOR HAVING REVERSION PREVENTING DEVICE

(75) Inventor: Sung-Choon Kim, Busan (KR)

(73) Assignee: LG Electronics Inc. (KR)

( * ) Notice: Subject to any disclaimer, the term of this patent is extended or adjusted under 35 U.S.C. 154(b) by 0 days.

(21) Appl. No.: 10/162,727

(22) Filed: Jun. 4, 2002

(65) Prior Publication Data

US 2003/0035745 A1 Feb. 20, 2003

(30) Foreign Application Priority Data

Aug. 20, 2001 (KR) ..... 2001-50061

(51) Int. Cl.[7] ..... F01C 1/02
(52) U.S. Cl. ..... 418/55.1; 418/69
(58) Field of Search ..... 418/55.1, 69

(56) References Cited

U.S. PATENT DOCUMENTS 4,998,864 A * 3/1991 Muir ..... 418/69
5,593,294 A * 1/1997 Houghtby et al. ..... 418/55.1
6,264,445 B1 7/2001 Beck et al.

FOREIGN PATENT DOCUMENTS

EP 537884 A1 * 4/1993 ..... F04C/18/02
EP 0 731 277 A1 9/1996
JP 05172065 A * 7/1993 ..... F04C/18/02

OTHER PUBLICATIONS

Search Report from European Patent Office and transmittal cover page dated Apr. 2, 2003.

* cited by examiner

*Primary Examiner*—Thomas Denion
*Assistant Examiner*—Theresa Trieu
(74) *Attorney, Agent, or Firm*—Ostrolenk, Faber, Gerb & Soffen, LLP

(57) ABSTRACT

A scroll compressor having a reversion preventing device includes: a driving unit inserted in a closed casing and generating a driving force; a compressing unit for compressing and discharging a fluid when the driving unit is driven; a rotational shaft rotatably supported by a main frame and a sub-frame that are fixed at the casing and transmitting the rotational force generated from the driving unit to the compressing unit; and a reversion preventing device installed at one side of the rotational shaft and stopping the rotation of the rotational shaft when the driving unit is rotated in a direction opposite to the direction in which the driving unit compresses the fluid. Since the reversion preventing device is installed at the rotational shaft in order to stop the rotation of the rotational shaft if the rotational shaft is rotated in the reverse direction, blocking the driving unit from being rotated in the reverse direction. Thus, an abnormal vibration and a noise occurrence of the driving unit can be prevented, and thus, a reliability of the compressor can be improved.

8 Claims, 5 Drawing Sheets

SCROLL COMPRESSOR HAVING REVERSION PREVENTING DEVICE

BACKGROUND OF THE INVENTION

1. Field of the Invention

The present invention relates to scroll compressor, and more particularly, to a scroll compressor, and more particularly, to a scroll compressor having a reversion preventing device that is capable of preventing a driving unit of a compressor from rotating in the opposite direction of a rotational direction to compress a fluid.

2. Description of the Background Art

In general, various types of compressors can be adopted according to a compression method, and a scroll compressor is mostly used for an air-conditioning device that requires a small and light compressor.

FIG. 1 is a sectional view of a scroll compressor in accordance with a conventional art.

As shown in FIG. 1, the conventional scroll compressor includes: a casing 106 having a suction pipe 102 for sucking a fluid and a discharge pipe 104 for discharging a compressed fluid that are connected and having a closed certain space; a driving unit 108 disposed at a lower side of the casing 106 and generating a driving force; and a compressing unit 110 disposed at an upper side of the casing 106, connected to the driving unit 108 and the rotational shaft 112 to compress the fluid sucked into the suction pipe 102 according to the rotation of the rotational shaft 112 and discharge it to the discharge pipe 104.

A main frame 113 is installed at an upper side of the casing 106 to rotatably support the upper side of the rotational shaft 112 and support the compressing unit 110, and a lower frame 114 is installed at a lower side of the casing 106 to rotatably supporting the lower side of the rotational shaft 112.

A separating panel 120 is installed at one side of the casing 106, sectioning the inside of the casing 106 into a lower pressure side and a high pressure side.

The driving unit 108 includes a stator 122 fixed in the circumferential direction of the casing 106 and a rotor 124 disposed at the inner circumferential face of the stator 122 and fixed at the rotational shaft 112, so that when power is applied to the stator 122, the rotor 124 is rotated according to the interaction between the stator 122 and the rotor 124, to thereby rotate the rotational shaft 112.

The compressing unit 110 includes a fixed scroll 127 having a fixed vane 126 in an involute shape and being fixed at the separating panel 120; and an orbiting scroll 132 having an orbiting vane 130 in an involute shape corresponding to the fixed vane 126 to have a certain compression space between itself and the fixed vane 126, being orbitably supported by the support frame 114, and orbiting when the rotational shaft 112 is rotated.

A discharging passage 136 is formed at the central portion of the fixed scroll 128 to discharge the fluid compressed according to the interaction between the fixed vane 126 and the orbiting vane 130, and a check valve 138 is installed at an upper side of the discharging passage 136 to prevent reversion of the discharged fluid.

In the above-described conventional scroll compressor, when power is applied to the stator 122, the rotor 124 is rotated according to the interaction between the stator 122 and the rotor 124, and the rotational shaft 112 fixed at the rotor 124 is rotated in a normal direction.

Then, the orbiting scroll 132 is moved in an orbiting manner according to the rotation of the rotational shaft 112, to compress the fluid sucked through the suction pipe 102 owing to the interacton with the fixed scroll 127 and discharge outwardly the compressed fluid through the discharge pipe 104.

At this time, the fluid discharged to the high pressure side through the discharging passage 136 is prevented from reversing by the check valve 138 installed at the discharging passage 136.

The upper side and lower side of the rotational shaft 112 are rotatably supported by the main frame 114 and the lower frame 114, respectively, and rotated in the normal direction according to the driving of the driving unit 108.

However, the conventional scroll compressor has the following problem.

That is, in case of employing a single phase motor as the driving unit generating the rotational force, if a load generated during the operation of the compressor becomes greater than a motor torque, the rotational force of the motor is reduced, and moreover, the motor is reversely rotated, causing an abnormal vibration of the compressor and an abnormal noise, resulting in that a reliability of the compressor is degraded.

In addition, in case of employing a three phase motor as the driving unit generating the rotational force, if a connection of the motor is made erroneously, the motor is rotated in a reverse direction, causing an abnormal vibration and a noise, also resulting in that a reliability of the compressor is degraded.

SUMMARY OF THE INVENTION

Therefore, an object of the present invention is to provide a scroll compressor having a reversion preventing device in which when a driving unit of a compressor is rotated in a normal direction, the rotation is allowed, while when the driving unit is rotated in a reverse direction, its rotation is stopped, thereby preventing occurrence of an abnormal vibration and noise of the driving unit and improving a reliability of the compressor.

To achieve these and other advantages and in accordance with the purpose of the present invention, as embodied and broadly described herein, there is provided a scroll compressor having a reversion preventing device including: a driving unit inserted in a closed casing and generating a driving force; a compressing unit for compressing and discharging a fluid when the driving unit is driven; a rotational shaft rotatably supported by a main frame and a sub-frame that are fixed at the casing and transmitting the rotational force generated from the driving unit to the compressing unit; and a reversion preventing device installed at one side of the rotational shaft and stopping the rotation of the rotational shaft when the driving unit is rotated in a direction opposite to the direction in which the driving unit compresses the fluid.

The reversion preventing device of the scroll compressor of the present invention includes: an eccentric part formed eccentrically as long as a certain distance from the center of the rotational shaft at one side of the rotational shaft; an eccentric ring rotatably inserted in a certain range into the eccentric part, and formed such that the center of an inner diameter is eccentric as long as a certain distance from the center of an outer diameter; a supporting part formed to be corresponded to the center of the rotational shaft at an outer side of the rotational shaft, so as to limit a rotational range of the eccentric ring; and a stopper protruded upwardly from the lower frame and interfering the eccentric ring when the rotational shaft is rotated in a reverse direction.

In the scroll compressor having a reversion preventing device of the present invention, the eccentric part of the reversion preventing device is formed as a disk type having a radius larger than the radius of the rotational shaft at the outer circumferential surface of the rotational shaft, and the center of the eccentric part is eccentric as long as a certain distance from the center of the rotational shaft.

In the scroll compressor having a reversion preventing device of the present invention, the supporting part of the reversion preventing device is formed as a disk type extended in a right angle direction of the rotational shaft from the lower surface of the eccentric part, and a hinge pin is protruded upwardly from the upper side of the opposite side of the portion that is eccentric of the eccentric part.

In the scroll compressor having a reversion preventing device of the present invention, the supporting part of the reversion preventing device has a radius larger than that of the eccentric part, and the center of the supporting part is corresponded to the center of the rotational shaft.

In the scroll compressor having a reversion preventing device of the present invention, the eccentric ring of the reversion preventing device is formed as a disk type with a certain thickness, and a slot in a circular arc shape is formed as long as a certain distance from the center of the portion that is eccentric of the eccentric ring.

In the scroll compressor having a reversion preventing device of the present invention, the slot of the reversion preventing device is formed having a range of about 45° from the center of the outer diameter of the eccentric ring.

In the scroll compressor having a reversion preventing device of the present invention, the stopper of the reversion preventing device has a certain curvature radius protruded upwardly of the upper frame and is maintained to have a certain interval from the outer diameter of the eccentric ring.

In the scroll compressor having a reversion preventing device of the present invention, the center of the rotational shaft of the reversion preventing device, the center of the eccentric part and the center of the hinge pin come in a straight line.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may include a plurality of embodiments of a scroll compressor having a reversion preventing device in accordance with the present invention, of which the most preferred one will now be described.

Figure 1:
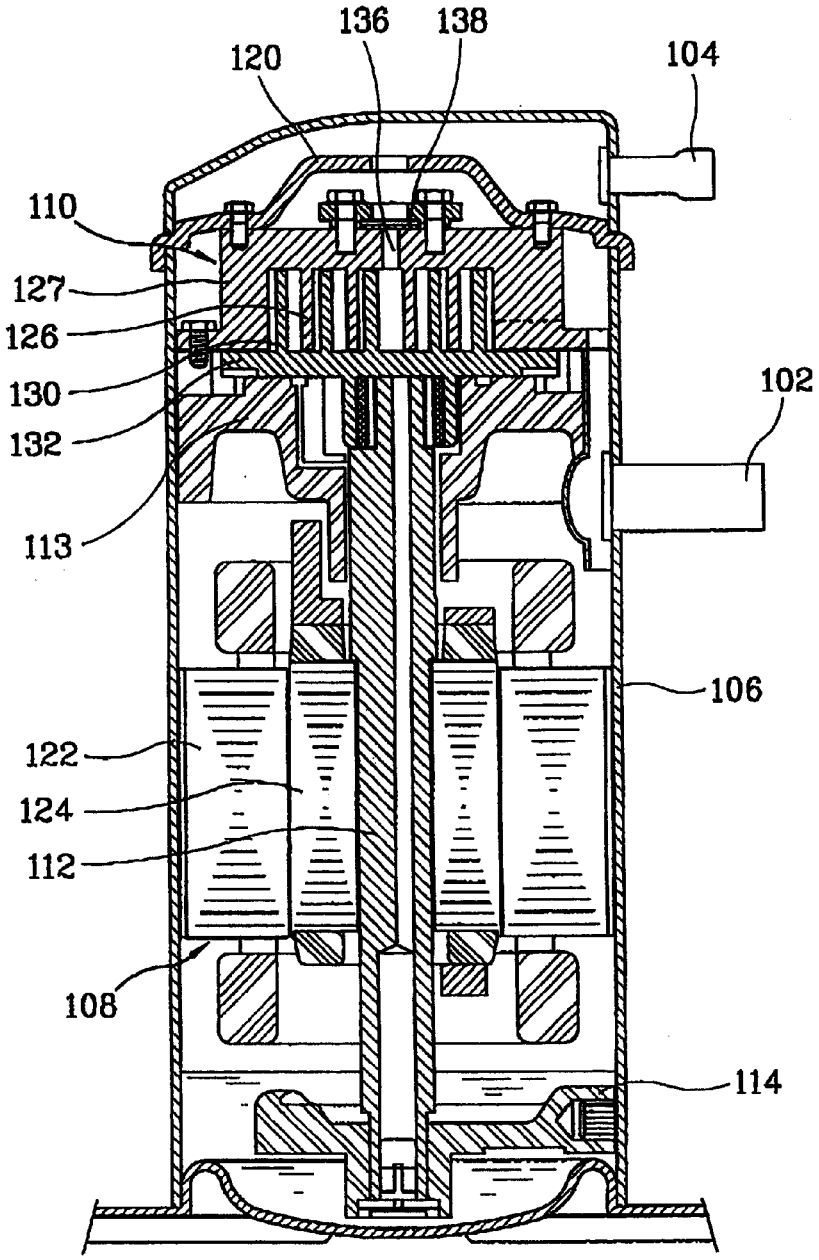
FIG. 1 BACKGROUND ART
FIG. 1 is a sectional view showing a scroll compressor in accordance with a conventional art.
Figure 2:
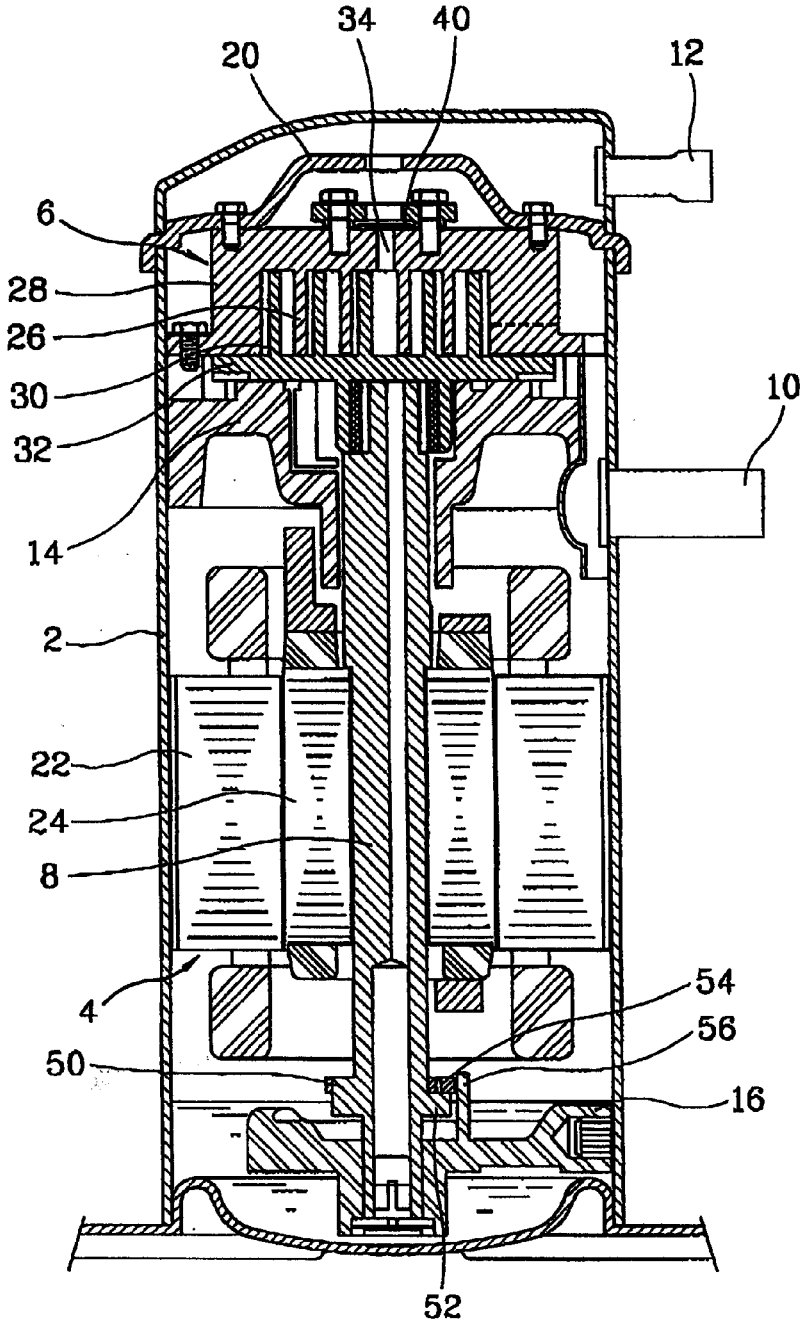
FIG. 2 is a sectional view showing a scroll compressor having a reversion preventing device in accordance with the present invention.

FIG. 2 is a sectional view showing a scroll compressor having a reversion preventing device in accordance with the present invention.

The scroll compressor of the present invention includes: a casing 2 having a closed space; a driving unit 4 inserted in the casing 2 and generating a driving force; a compressing unit 6 connected to the driving unit 4 by a rotational shaft 8 so as to compress a fluid and discharge it outwardly when the driving unit 4 is driven; and a reversion preventing device installed at one side of the rotational shaft 8 and preventing reversion of the driving unit 4.

A suction pipe 10 for sucking a fluid and a discharge pipe 12 for discharging the compressed fluid are respectively connected at one side of the casing 2. Inside the casing 2, a main frame 14 for rotatably supporting the upper side of the rotational shaft 8 and supporting the compressing unit 6, and a lower frame 16 for rotatably supporting the lower side of the rotational shaft 8 are installed.

A separating plane 20 is installed at an upper side of the casing 2, sectioning the inside of the casing 2 into a high pressure side and a lower pressure side.

The driving unit 4 includes a stator 22 fixed at an inner circumferential face of the casing 2 and a rotor 24 disposed at the inner circumferential face of the stator 22 and fixed at the rotational shaft 8, so that when power is applied to the stator 22, the rotor 24 is rotated according to an interaction between the stator 22 and the rotor 24, thereby rotating the rotational shaft 8.

The compressing unit 6 includes a fixed scroll 28 having a fixed vane 26 in an involute shape and fixed at the separating plane 20, and an orbiting scroll 32 having an orbiting vane 30 in an involute shape corresponding to the fixed vane 26 so as to have a certain compression space between itself and the fixed vane 26, being supported by the main frame 14 so as to be able to orbit and making an orbiting movement when the rotational shaft 8 is rotated.

A discharge hole 34 is formed at the center of the fixed scroll 28 to discharge the fluid compressed according to the interaction between the fixed vane 26 and the orbiting vane 30 toward the high pressure side.

A check valve 40 is installed at an upper side of the fixed scroll 28 to open and close the discharge hole 34 to prevent reversion of the fluid discharged toward the high pressure side.

The upper portion and the lower portion of the rotational shaft 8 are rotatably supported by the main frame 14 and the lower frame 16, a central portion of which is fixed at the rotor 24 and the upper end portion thereof is eccentrically connected to the orbiting scroll 32 so as to transmit the rotational force of the driving unit 4 to the compressing unit 6. At a certain lower portion thereof, a reversion preventing device is installed to prevent reversion of the driving unit 4.

Figure 3:
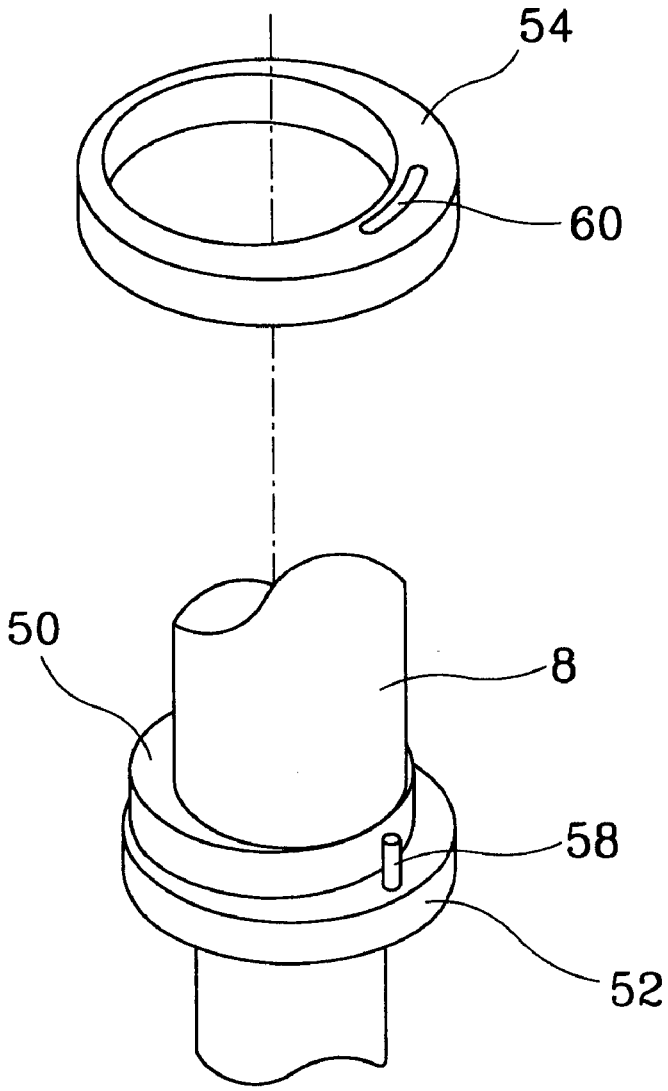
FIG. 3 is an exploded perspective view showing the reversion preventing device of the scroll compressor in accordance with the present invention.

As shown in FIG. 3, the reversion preventing device includes: an eccentric part 50 formed at a lower portion of the rotational shaft 8 so as to be eccentric as long as a certain distance from the center of the rotational shaft 8; an eccentric ring 54 rotatably inserted to the outer circumferential face of the eccentric part 50, and the center of the inner diameter being eccentric as long as a certain width from the center of an outer diameter; a supporting part 52 supporting the eccentric ring 54 and limiting a rotation range of the eccentric ring 54; and a stopper 56 vertically protruded from the lower frame 16 and stopping a reversion of the rotational shaft 8 by being interfered with the eccentric ring 54 when the driving unit 4 is rotated reversely.

Figure 4:
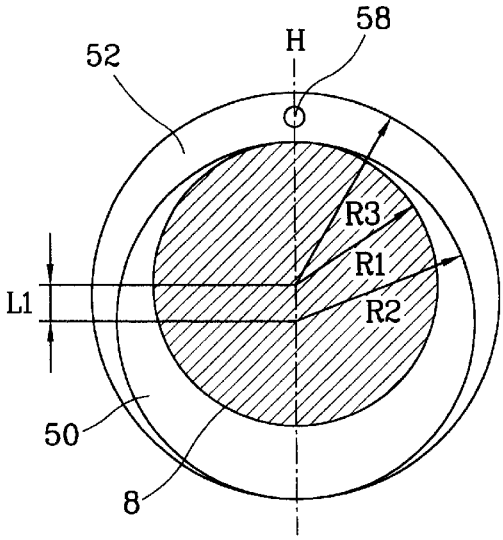
FIG. 4 is a sectional view taken along line I—I of FIG. 3 in accordance with the present invention.

As shown in FIG. 4, the eccentric part 50 is formed as a disk type having a radius R2 greater than the radius R1 of the rotational shaft at the outer circumferential face of the rotational shaft 8, and the center of the eccentric part 50 is eccentric as long as a certain distance L1 from the center of the rotational shaft 8.

As shown in FIG. 4, the supporting part 52 is formed as a disk type extended at a right angle direction of the rotational shaft 8 from the lower surface of the eccentric part 50 and has a radius R3 greater than the radius R2 of the eccentric part 50. The center of the supporting part 52 corresponds to the center of the rotational shaft 8.

A hinge pin 58 is protruded in a vertical direction at the side opposite to the portion that is eccentric of the eccentric part 50.

The center of the rotational shaft, the center of the eccentric part and the center of the hinge pen come in the straight line (P).

Figure 5:
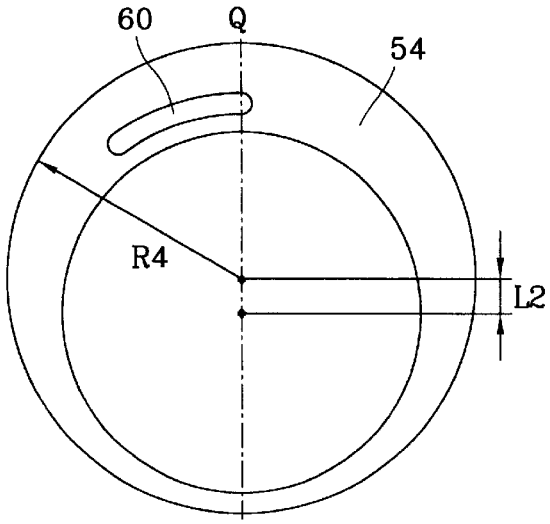
FIG. 5 is an upper side view of an eccentric ring of the reversion preventing device in accordance with the present invention.

As shown in FIG. 5, the eccentric ring 54 is formed as a disk type with a certain thickness having a structure that the center of an inner diameter and the center of an outer diameter are eccentric as much as the eccentric amount L2.

The eccentric ring 54 is rotatably inserted into the eccentric part 50 and supported by the supporting part 52 so as not to be released.

The outer diameter R4 of the eccentric ring 54 is greater than the radius R3 of the supporting part 52, and a slot 60 in an arc shape is formed at one side of the eccentric ring 54, into which the hinge pin 58 is inserted.

The slot 60 is formed such that its one end portion is positioned at a portion that is the longest at the center of the inner diameter of the eccentric ring 54, and the slot 60 is formed at about 45° in the circumferential direction.

The center of the inner diameter of the eccentric ring, the center of the outer diameter of the eccentric ring and one end portion of the slot of the eccentric ring are positioned in a straight line (Q).

When the eccentric ring 54 is insertedly assembled in the eccentric part 50, the center of the outer diameter of the eccentric ring 54 and the center of the rotational shaft 8 are corresponded.

In this manner, as for the reversion preventing device, when the rotational shaft 8 is rotated in the normal direction, the direction in which itself compresses the fluid, the reversion preventing device corresponds with the center of the rotational shaft 8, not affecting the rotation of the rotational shaft 8.

The stopper 56 is formed to have a certain curvature radius maintaining a certain interval with the outer circumferential face of the eccentric ring 54 when the center of the outer diameter of the eccentric ring 54 is positioned to correspond with the center of the rotational shaft 8.

Thus, when the rotational shaft 8 is rotated in the normal direction, the stopper 56 maintains a certain space from the eccentric ring 54, not affecting the rotation of the rotational shaft 8. If, however, the rotational shaft 8 is rotated in the reverse direction, the center of the rotational shaft 8 and the center of the outer diameter of the eccentric ring 54 become different to each other. Then, the outer side of the eccentric ring 54 and the inner side of the rotational shaft 8 are interfered with each other, and thus, the reverse rotation of the rotational shaft 8 is suspended.

The operation of the reversion preventing device of the scroll compressor of the present invention constructed as described will now be explained.

Figure 6:
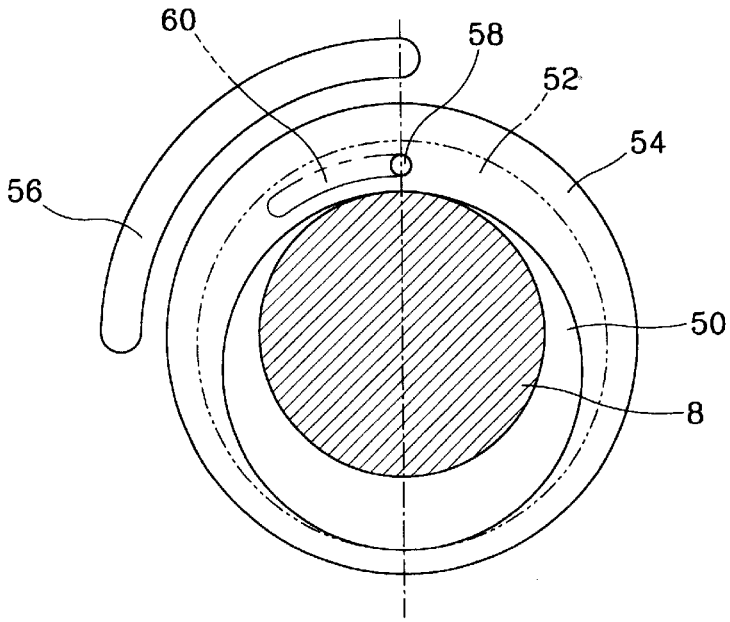
FIG. 6 is an upper side view showing an operation state of the reversion preventing device when a rotational shaft of the scroll compressor is rotated in a normal direction.
Figure 7:
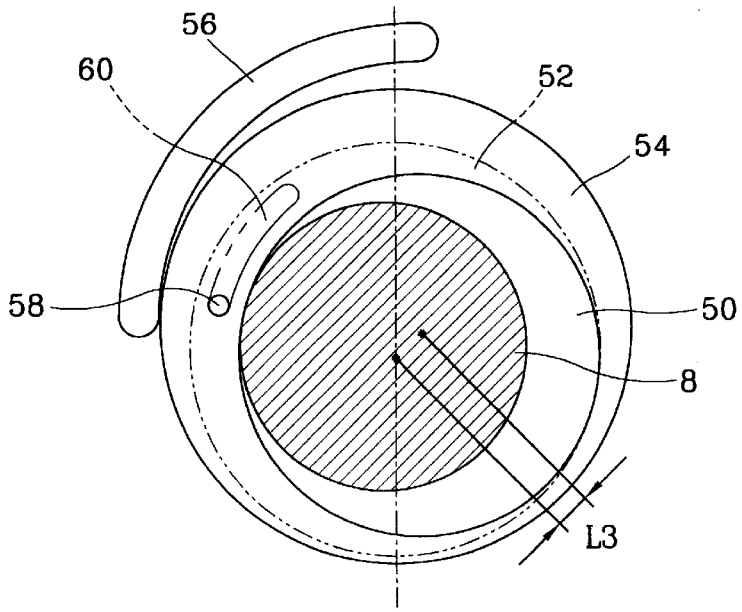
FIG. 7 is an upper side view showing an operation state of the reversion preventing device when a rotational shaft of the scroll compressor is rotated in a reverse direction.

FIGS. 6 and 7 show operational states of the reversion preventing device of the scroll compressor in accordance with the present invention.

First, when the driving unit 4 is rotated in the normal direction (S), that is, the direction in which the driving unit compresses a fluid, as shown in FIG. 6, the eccentric part 50 and the supporting part 52 are rotated together, and accordingly, the hinge pin 58 formed at the supporting part 52 is moved along the slot 60 and positioned at one portion of the slot 60.

Then, the center of the outer diameter of the eccentric ring 54 and the center of the rotational shaft 8 correspond and a certain interval is maintained between the eccentric ring 54 and the stopper 56.

At this time, since the mutual combination of the eccentric part 50, the supporting part 52 and the eccentric ring 54 makes a concentric circle with the rotational shaft 8, so that no influence is made to the rotation of the rotational shaft 8.

Meanwhile, if the driving unit 4 is rotated in the reverse direction, the opposite direction in which the driving unit 4 sucks the fluid, as shown in FIG. 7, the rotational shaft 8 is rotated in the reverse direction, and accordingly, the eccentric part 50 and the supporting part 52 are rotated in the reverse direction like the rotational shaft 8.

At this time, the hinge pin 58 formed at the supporting part 52 is moved along the slot 60 and positioned at the other end portion of the slot 60.

Then, the center of the outer diameter of the eccentric ring 54 goes beyond the center of the rotational shaft 8, and at this time, the outer face of the eccentric ring 54, the farthest from the center of the rotational shaft 8 is interfered by the stopper 56, stopping the reverse rotation of the rotational shaft 8.

As so far described, the scroll compressor having a reversion preventing device of the present invention has the following advantage.

That is, since the reversion preventing device is installed at the rotational shaft in order to stop the rotation of the rotational shaft if the rotational shaft is rotated in the reverse direction, blocking the driving unit from being rotated in the reverse direction. Thus, an abnormal vibration and a noise occurrence of the driving unit can be prevented, and thus, a reliability of the compressor can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such metes and bounds are therefore intended to be embraced by the appended claims.

What is claimed is:

1. A scroll compressor having a reversion preventing device comprising:

a driving unit inserted in a closed casing and generating a driving force;

a compressing unit for compressing and discharging a fluid when the driving unit is driven;

a rotational shaft rotatably supported by a main frame and a sub-frame that are fixed at the casing and transmitting the rotational force generated from the driving unit to the compressing unit; and a reversion preventing device installed at one side of the rotational shaft and stopping the rotation of the rotational shaft when the driving unit is rotated in a direction opposite to the direction in which the driving unit compresses the fluid; and wherein the reversion preventing device comprises an eccentric part formed eccentrically as long as a certain distance from the center of the rotational shaft at one side of the rotational shaft;

an eccentric ring rotatably inserted in a certain range into the eccentric part, and formed such that the center of an inner diameter is eccentric as long as a certain distance from the center of an outer diameter;

a supporting part formed to be corresponded to the center of the rotational shaft at an outer side of the rotational shaft, so as to limit a rotational range of the eccentric ring; and a stopper protruded upwardly from the lower frame and interfering the eccentric ring when the rotational shaft is rotated in a reverse direction.

2. The scroll compressor of claim 1, wherein the eccentric part is formed as a disk type having a radius larger than the radius of the rotational shaft at the outer circumferential surface of the rotational shaft, and the center of the eccentric part is eccentric as long as a certain distance from the center of the rotational shaft.

3. The scroll compressor of claim 1, wherein the supporting part is formed as a disk type extended in the right angle direction of the rotational shaft from the lower surface of the eccentric part, and a hinge pin is protruded upwardly from the upper side of the opposite side of the portion that is eccentric of the eccentric part.

4. The scroll compressor of claim 3, wherein the supporting part has a radius larger than that of the eccentric part, and the center of the supporting part is corresponded to the center of the rotational shaft.

5. The scroll compressor of claim 1, wherein the eccentric ring is formed as a disk type with a certain thickness, and a slot in an arc shape is formed as long as a certain distance from the center of the portion that is eccentric of the eccentric ring.

6. The scroll compressor of claim 5, wherein the slot is formed having a range of about 45° from the center of the outer diameter of the eccentric ring.

7. The scroll compressor of claim 1, wherein the stopper has a certain curvature radius protruded upwardly of the upper frame and is maintained to have a certain interval from the outer diameter of the eccentric ring.

8. The scroll compressor of claim 1, wherein the center of the rotational shaft of the reversion preventing device, the center of the eccentric part and the center of the hinge pin come in a straight line.

* * * * *